United States Patent [19]

Tucker

[11] Patent Number: 4,729,692

[45] Date of Patent: Mar. 8, 1988

[54] APPARATUS AND METHOD FOR QUIETING FLOWING WATERS

[75] Inventor: Terrence N. Tucker, Vincentown, N.J.

[73] Assignee: Intrusion-Prepakt Incorporated, Cleveland, Ohio

[21] Appl. No.: 940,503

[22] Filed: Dec. 11, 1986

[51] Int. Cl.[4] ..... E02B 7/00

[52] U.S. Cl. ..... 405/107; 405/90; 405/106; 405/116

[58] Field of Search ..... 405/102–116, 405/12–14, 87–90; 114/26, 266

[56] References Cited

U.S. PATENT DOCUMENTS

| | | | |
|---|---|---|---|
| 15,317 | 7/1856 | Craig | 405/116 |
| 249,024 | 11/1881 | Dechant | 405/107 |
| 277,732 | 5/1883 | Howell | 405/107 |
| 799,828 | 9/1905 | Church | 405/110 |
| 954,257 | 4/1910 | Coburn | 405/106 |
| 1,562,465 | 11/1925 | Nelson | 405/116 X |
| 1,567,715 | 12/1925 | DeWitt | 405/106 |
| 1,918,015 | 7/1933 | Broome | 405/106 X |
| 2,079,889 | 5/1937 | Wichert | 405/13 |
| 2,217,470 | 10/1940 | Collier | 405/107 |
| 2,272,236 | 2/1942 | Brockhurst | 405/14 |
| 2,949,744 | 8/1960 | Swatek | 405/14 |
| 3,845,631 | 11/1974 | Malan | 405/116 |
| 3,931,778 | 1/1976 | Miller et al. | 114/26 |

FOREIGN PATENT DOCUMENTS

| | | | |
|---|---|---|---|
| 469396 | 11/1950 | Canada | 405/11 |
| 450078 | 10/1927 | Fed. Rep. of Germany | 405/11 |
| 309839 | 8/1933 | Italy | 405/107 |
| 485183 | 5/1938 | United Kingdom | 405/12 |

OTHER PUBLICATIONS

Long Sault Rapids by J. Patterson, J. M. ASCE, Civil Engineering, Jun. 1956, pp. 42–45, (vol. pp. 366–369).

*Primary Examiner*—Dennis L. Taylor
*Attorney, Agent, or Firm*—J. Herman Yount, Jr.

[57] ABSTRACT

A method and apparatus for quieting flowing waters in which a wall supported by a barge crosswise of water flow with structural members of the wall engaging an underwater obstruction to prevent the wall and barge from moving with the flow of water whereby the wall is adapted to divert water flow around the wall to provide a quiet water working area ahead of the wall. The wall comprises a plurality of gates supported by the structural members for movement relative thereto so that the wall may be raised under adverse conditions to allow the floating platform to rise with high waters with the structural members of the wall being maintained in engagement with the obstruction to prevent or aid in preventing the floating platform from moving with the flow. Under normal conditions, the floating platform will rise and fall with the wall in its water quieting position and the structural members of the wall maintaining engagement with the underwater obstructon. The apparatus and method may be used in conjunction with a dam having a vertical upstream face engaged by the structural members and the underwater wall being such as to quiet waters on the downstream side of the dam to provide a safe working area for workmen repairing or modifying the downstream or spillway of the dam or modifying the dam surface or spillway.

18 Claims, 8 Drawing Figures

APPARATUS AND METHOD FOR QUIETING FLOWING WATERS

The present invention relates to a method and apparatus for quieting water for divers and the like, and particularly for divers or other workmen working on a downstream face or spillway of a dam to repair or modify the face and spillway. The invention will be described in connection with such a dam. However, the invention is applicable where waters of rivers, streams, lakes, or other bodies are to be quieted to allow workmen to work in a particular area.

BACKGROUND OF INVENTION

The downstream faces and spillways of dams are subject to severe damage from large volumes of water flowing rapidly over the dam, from debris carried with the water, and from exposure to extreme variations of temperature. To repair or modify the downstream face or spillway often requires work to be done under water and it is highly desirable to eliminate, reduce or otherwise control the flow of water over the dam in the area of the surfaces to be repaired so that divers or other workmen can work safely in the area.

It has been necessary in the past, in those instances where the dam was not equipped with permanent gates, to install temporary gates along the crest of the dam to restrict or block the flow of water in the area of the gate, the gates being secured to the dam with structural fittings. Frequently it was necessary to install these temporary gates while water flowed at high velocity over the crest of the dam. This is an expensive and dangerous procedure. I have found that this expense and danger can be largely avoided by use of my invention.

Apart from temporary gates fixed to the dam, conventional techniques have also utilized barges which are floated against the upstream side of the dam in an attempt to divert the water around the area of the workers immediately downstream of the dam and to minimize the water flowing over the dam in that area. This presents problems in that the barge or float must have sufficient depth to hold it against the dam and even then may float over the dam with rising waters. Often the wind and/or flowing water makes it difficult to keep the barge in position for blocking the flow of water over the dam and to keep the barge from floating over the dam.

Another technique for quieting waters for workmen is shown in U.S. Pat. No. 901,104. This patent utilizes a cassion which forms an enclosure for a work area on the bottom of the water body. The enclosure is lowered from an interior well of a floating barge or vessel and has a movable lower wall portion for forming the lower part of each side. This part is movable with and relative to an upper wall portion for that side.

SUMMARY OF INVENTION

In accordance with my invention, a barge or float, a shallow draft barge if the body of water is not free of relatively shallow obstructions, is provided with water-flow-blocking means mounted on a barge or float preferably along one side thereof, to extend downwardly from the float or barge to engage an underwater obstruction and block significant water flow or significantly reduce the velocity of the flow to or in an area off the side of the water blocking means. The water blocking means comprises a structural means for engaging the obstruction and maintaining engagement therewith as the barge rises and falls with the level of the water, the movement of the barge with the water flow being blocked by the engagement of the structural means with the obstruction and the water helping to hold the barge in position against the obstruction.

The water-flow-blocking means comprises a wall means for blocking water flowing transversely of the wall means and the structural means adapted to engage said obstruction being at places distributed along the length of the wall means.

In the preferred embodiment, the water-flow-blocking means comprises laterally spaced structural members, which may be H-beams, mounted on a side of the float and gate members extending between adjacent ones of the structural members for blocking or significantly restricting the flow of water or the velocity of flow into an adjacent area. The structural members engage an obstruction, a dam in the illustrated embodiment, to maintain the barge or float in position against the flow of water and to block or restrict water flow or the velocity of flow into an area outwardly of the wall, e.g., in the illustrated embodiment, over the length of the dam adjacent the structural members and gate members.

In a preferred embodiment, the gate members may be moved from what are water-flow-blocking positions in which they may extend to the bottom of the structural members or beyond. The gate members are preferably movable so that they may be raised to let the water freely flow through the water blocking means while maintaining engagement of the structural members with the obstruction to enable securing the barge under adverse conditions which may carry the barge, for example, over a dam on which repair or modifying work is being done. By allowing the water to flow freely underneath the barge and maintaining engagement of the structural member with the upstream dam face, the barge may be held, with the help auxiliary lines, if necessary, against going downstream where without the action of the structural members it would be extremely difficult to rig auxiliary lines to maintain the barge in position against the water flow.

In accordance with the invention it is not necessary to block the total flow of water into the work area, for example, water may flow around the ends of the outer members and into the area to be quieted as long as the velocity is reduced to make it safe for divers or other workmen. In some cases, the upstream face of the dam may be inclined downwardly in an upstream direction which would make it difficult to prevent the flow of water around the ends and along the water blocking wall into the work area, but the restriction of the water flow by the wall means, if the latter has sufficient length, will accomplish the necessary quieting of the water.

Further in accordance with the invention, the structural members are mounted on the side of the barge for adjustment relative thereto as well as the gate members being selectively positionable at various positions relative to the structural members to provide flexibility.

A preferred embodiment of my invention is described in the accompanying specification and is illustrated in the accompanying drawings incorporated into the specification for all matter disclosed therein and in which:

DESCRIPTION OF INVENTION

The present invention was proved workable in connection with a dam 20 (See FIG. 1) having a generally vertical upstream face with the downstream face 19 of the dam being slanted downwardly and downstream to minimize the effects of erosion from water spilling over the dam. The configuration of the dam on the downstream side was such that the water flowing over the dam would create a vortex and multiple deaths from drowning in the vortex had occurred. The downstream configuration of the dam and spillway 21 was to be repaired and changed to eliminate the vortex and it was necessary for workmen to work along the downstream face of the dam and the spillway to modify the spillway with concrete bags and to repair the downstream face of the dam. The problem was to provide a quiet water work area for the workmen while maintaining water flowing over the dam. Conventional barge sections were connected together to form a floating plantform. These barge sections had conventional connections for assembling the sections together to form a shallow draft barge. The barge had water-flow-blocking means of the present invention mounted on one side and was used to provide a quieted work area for the workmen.

Figure 1:
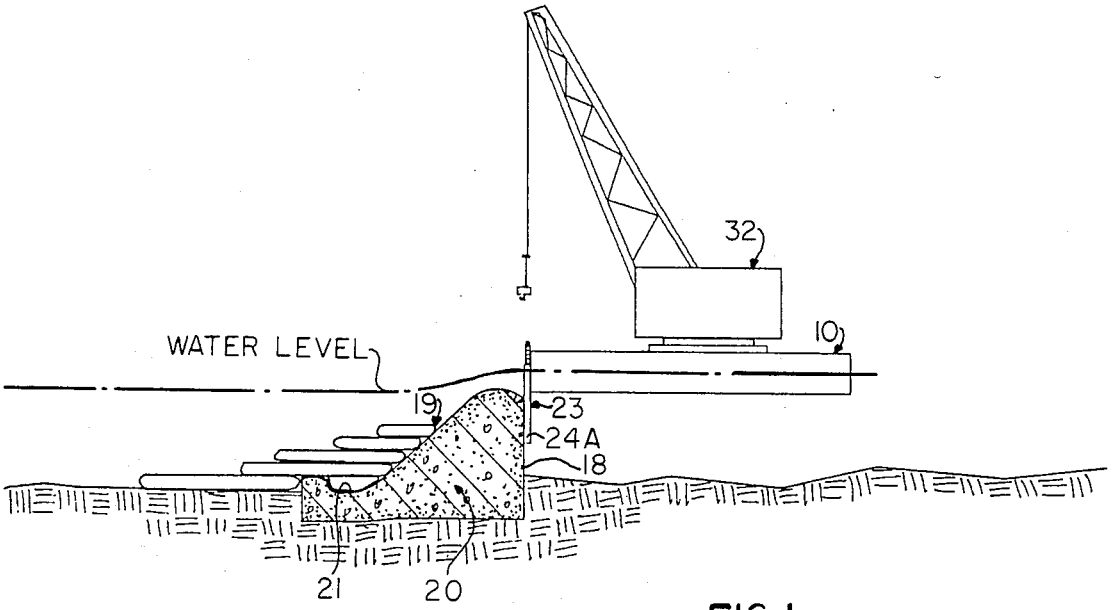
FIG. 1 is a diagramatic sectional view through a body of water having a dam and a water level normally higher than the top of the dam and illustrating a shallow draft barge with a water-flow-blocking means mounted on one side of a barge so as to engage the upstream face of the dam.
Figure 2:
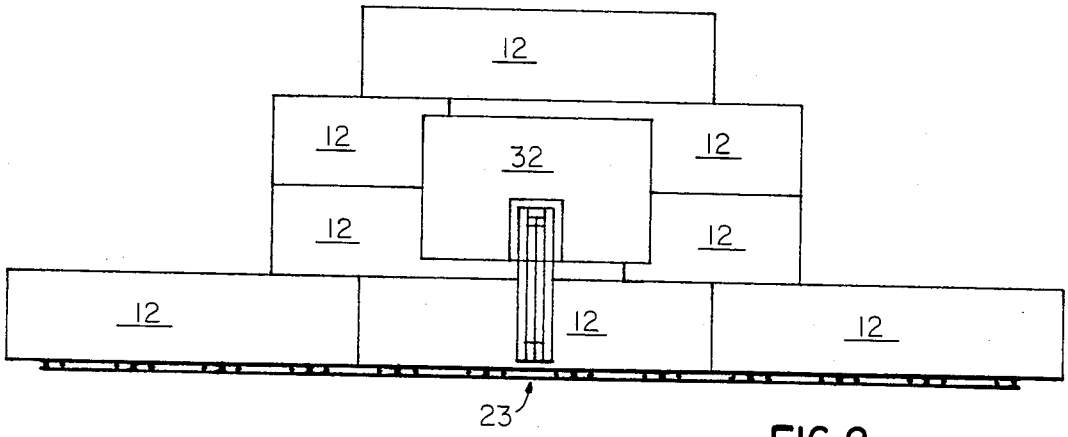
FIG. 2 is a plan view of the barge of FIG. 1.
Figure 3:
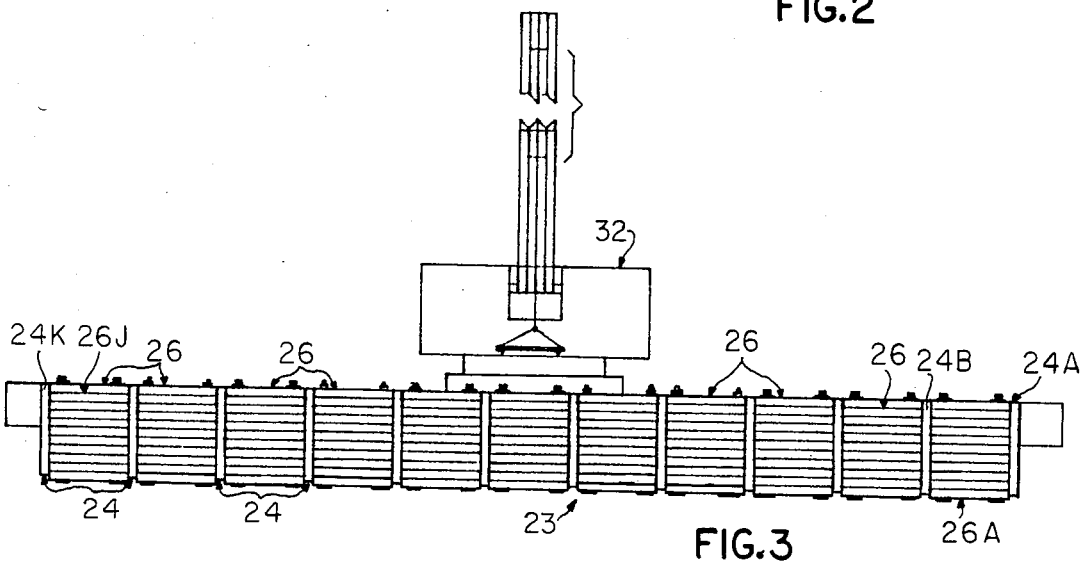
FIG. 3 is a front elevational view of the front side of the barge itself showing structural members and gate members in accordance with the preferred embodiment of the present invention.

In FIG. 1, a shallow draft barge 10 comprised of assembled sections 12 is shown disposed along the vertical upstream face 18 of the dam 20. The dam 20 has a downstream face 19 tapering downwardly and outwardly and forms a part of the spillway 21 to be repaired and modified by the placing and pumping of concrete bags which, after pumping, are shown in FIG. 1. This pumping and other work done under waters quieted by the use of the present invention. Mounted on the side of the barge adjacent the upstream dam face 18, was a water-flow-blocking means 23 of the present invention comprising spaced vertically extending structural members in the form of steel H-beams 24 which are respectively designated 24A, 24B, . . . 24K. The H-beams 24 are mounted on the barge and extend vertically upwardly and downwardly from the barge with the beams engaging the face 18 of the dam. Movable gates 26 are positioned between adjacent H-beams. The individual gates 26 have been designated by the reference numerals 26A, 26B, 26C, . . . 26J. The gates 26 are individually movable and can be adjusted vertically so as to extend to the lower ends of the H-beams, or below if desired, to form with the H-beams a wall extending downwardly from the barge along the dam to block water from flowing over the dam from underneath the barge and diverting the flow around the ends of the wall.

Figure 5:
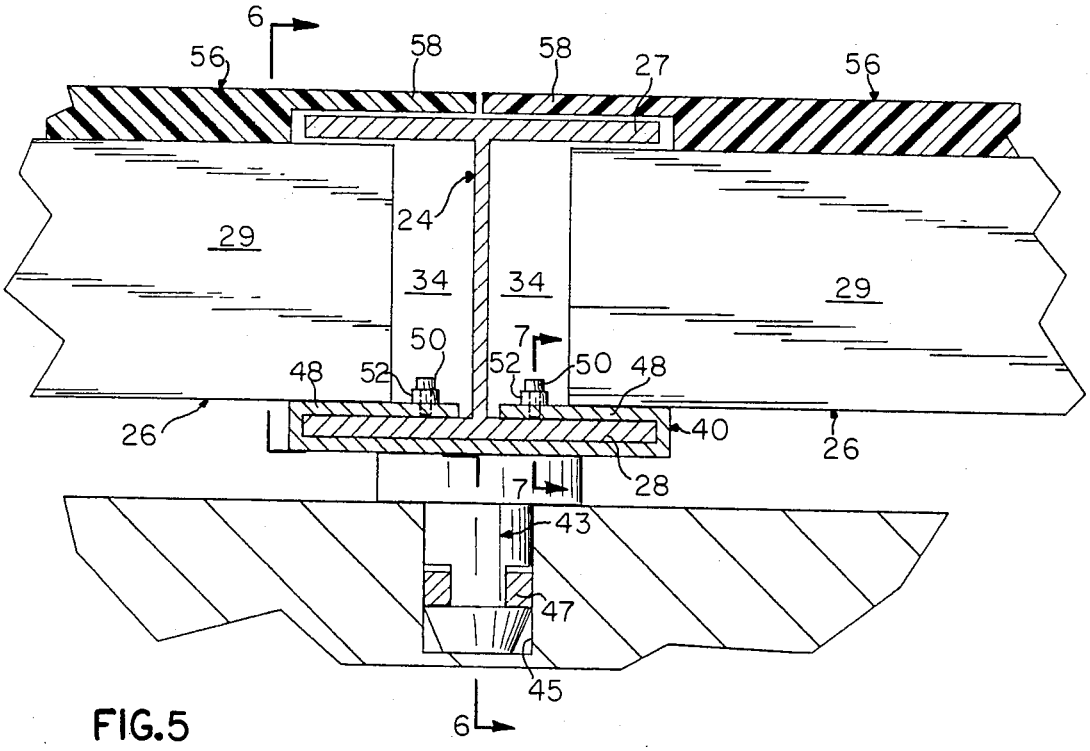
FIG. 5 is a horizontal cross-sectional view through the water blocking means of the preferred embodiment showing gate members and an H-beam of the apparatus of FIG. 1 and the connection of the structural member to the barge.

As best shown in FIG. 5, the gates 26 slide within channels 34 formed by parallel flanges 27, 28 of H-beams 24A-24K. Each of the movable gates 26 comprise a plurality of square timbers 29 (See FIG. 4) which are stacked in facing channels 34 of adjacent H-beam. The timbers for an individual gate 26 may be preassembled on shore with tie bars 30 which have threaded-on lifting eyes 31 at the top of the tie bars. The gate can then be lifted by a crane 32 (See FIG. 1) mounted on the barge to place the gates into position between its respective H-beams. The crane is also used to raise and lower the gates. When placed in position, the gates extend between adjacent H-beams and their ends formed by the ends of the timbers are received in the channels 34 formed by the flanges 27 and 28 of the respective H-beams.

Figure 6:
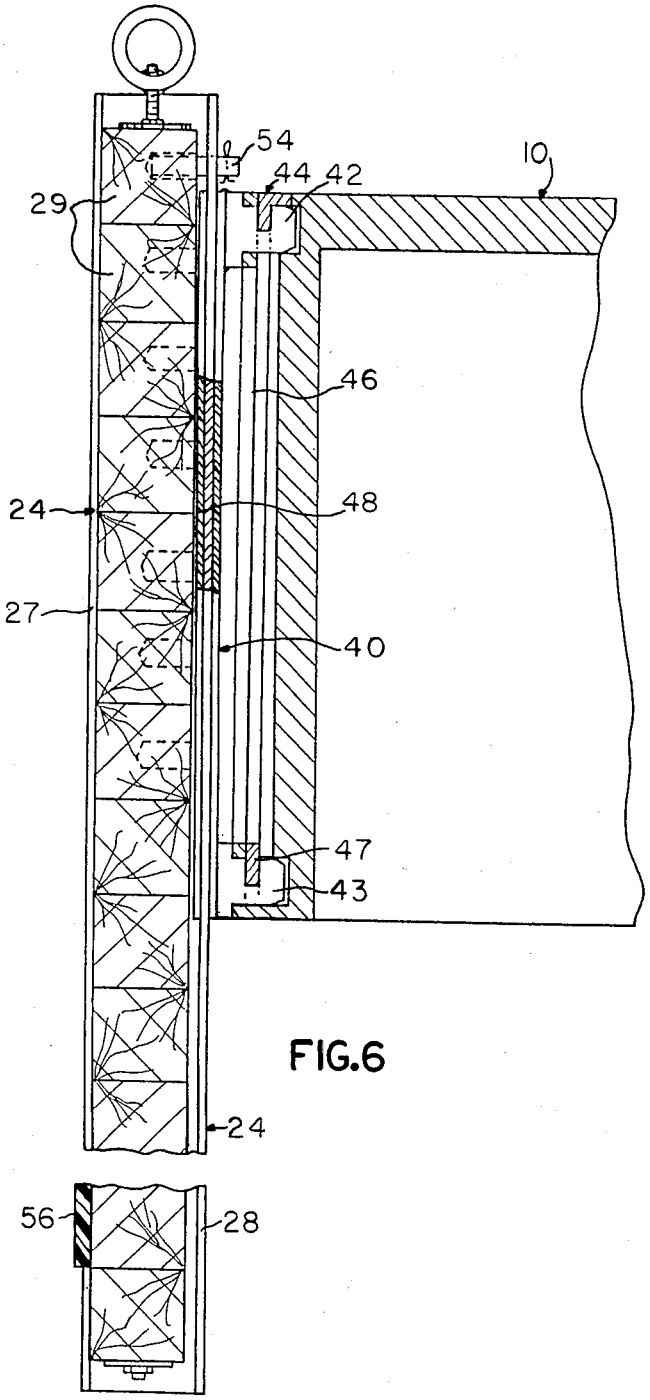
FIG. 6 is a vertical sectional view taken along line 6—6 of FIG. 5.
Figure 7:
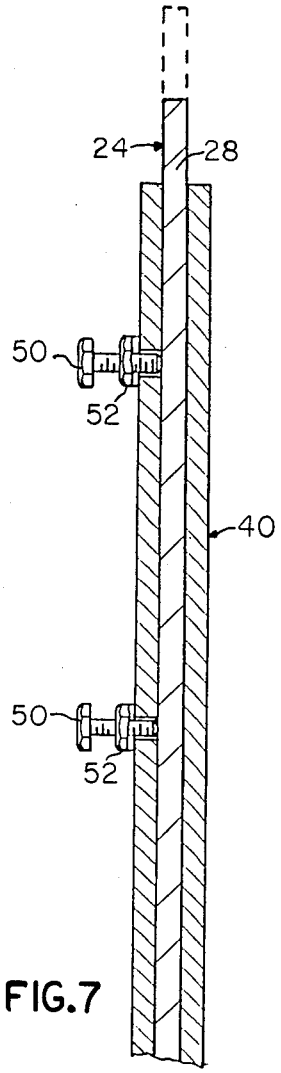
FIG. 7 is a vertical sectional line taken along line 7—7 of FIG. 5.
Figure 8:
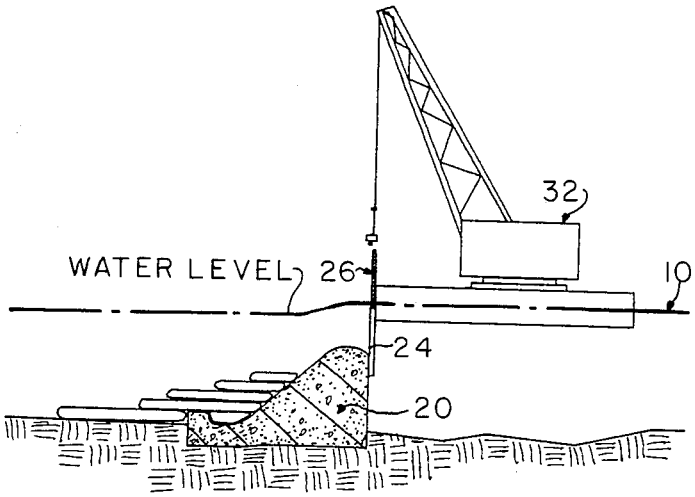
FIG. 8 is a view similar to FIG. 1 but showing the gate members in an elevated position for allowing water to flow from underneath the barge over the dam.

The H-beams are connected, to the side of the barge for vertical adjustment relative to the barge. As shown in FIGS. 5 and 6 each of the H-beams 24 is slidable in a guide 40 connected to the barge. Each guide 40 has welded thereto upper and lower male connectors 42, and 43 (See FIG. 6) constituting part of a releasable connecting means 44 for securing each guide 40 to the barge. Each connector 42, 43 is receivable in a respective opening 45 in the barge. The connecting means 44 is conventional and is of a type conventionally used to connect adjacent barge sections together and is well known in that art.

In addition to the male connectors 42, 43 the conventional connecting means 44 includes a locking slide bar 46 for each pair of connectors 42, 43. Each slide bar has spaced downwardly directed yoke-like portions 47 respectively located at the top and bottom ends of the slide bar which are dropped into upwardly facing pheripheral slots on the top portions of the male connectors 42, 43 to releasably lock the guide 40 to the barge.

Referring to FIG. 5, it will be noted that each guide has reentry portions 48 extending along the inside faces of the H-beam flange 28 adjacent the barge. A series of friction devices in the form of bolts 50 hold the H-beam against movement relative to the guide. The bolts 50 thread through nuts 52 which are welded to the portions 48 of the guides and extend through respective aligned openings in the guide to frictionally engage the inside of the flange 28 of the corresponding H-beam.

Each of the movable gates 24 may be held in a selected position by any suitable device, for example, by a pin 54 (FIG. 6) which extends through an opening in the flange 28 of an H-beam into a selected one of vertically spaced openings 53 drilled part way through the corresponding gate 24. The gates 24 may be adjusted to a desired position, extending below the H-beams if desired, and then pinned in position.

Figure 4:
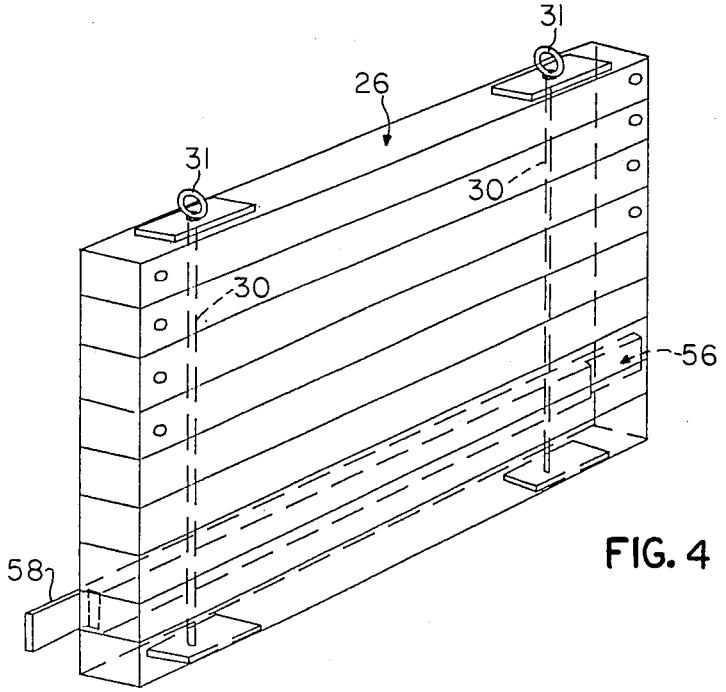
FIG. 4 is an illustration of a gate member for the water-flow-blocking means illustrated in FIGS. 1-3.

To increase the water blockage efficiency of the gating means of the present invention each gate may be provided with a gasket 56 of resilient material as shown in FIGS. 4 and 5. The resilient material will be forced against the upstream face of the dam and resiliently deform to better conform to irregularities in the dam to better block the flow of water. The ends of the gasket are preferably rebated to provide end portions 58 which extend over the outside flange 27 of the adjacent H-beams so that the gasket is pressed against the H-beam to minimize leakage between the gates and the H-beams as well as between the gates and the dam face.

The invention may be used in various environments to restrict or smooth water flow or wave action in a particular area. For example, the H-beams may extend downwardly to engage natural or other fixed obstructions entirely below or having portions extending below the water level with which the H-beams may engage to function as described. Such obstructions may be large rocks or geological formations along the bottom, and may be either natural or man-made. For example, when working along shore lines, water-flow-blocking means in accordance with the present invention may be lowered to engage underwater rocks or even pipe lines at a sufficient depth to block water flow and provide a quiet water area for working along the shore. In certain environments, the lower end of the structural members may be trapped between obstructions to hold the barge against wave action in either direction. The vertical extent of engagement of the obstruction and guides should be sufficient to maintain the guides and obstruction in engagement with rising water or for the wave action which may occur.

While the connecting means 44 has been generally detailed by the foregoing, the connecting means is shown in more detail in U.S. Pat. No. 3,057,315, the disclosure of which is incorporated herein by reference.

What I claim as my invention is:

1. An apparatus for use in moving water to quiet water in a work area comprising a float providing a work platform having water-flow-blocking means for quieting water in the work area, means mounting said water-flow-blocking means on said float to extend downwardly therefrom in a position crosswise of the water flow to substantially block the flow of water toward the work area from the position of the water blocking means, and to divert the water flow around the water-flow-blocking means, said water-flow-blocking means comprising an open ended wall to be positioned below the float crosswise of the water flowing to the work area and structural means connected to said float for supporting said wall and for engaging a fixed underwater obstruction to prevent movement of said float by the water and having a length for maintaining engagement with said obstruction as the float rises and falls with the water level.

2. An apparatus as defined in claim 1 in which said structural means comprises a plurality of vertical structural members distributed along said wall.

3. An apparatus as defined in claim 2 wherein said connecting means connects said vettical structural members to said float for vertical adjustment relative thereto.

4. An apparatus as defined in claim 1 wherein said wall comprises movable gate means operable to a raised position for allowing water flow to proceed past the wall position.

5. An apparatus is defined in claim 2 wherein said wall comprises gate means extending between adjacent ones of said structural members and supported for movement along said structural members.

6. An apparatus as defined in claim 5 wherein said gate means comprises a gate member received in channels defined by said structural members.

7. An apparatus as defined in claim 6 wherein said structural members comprise H-beams and gate members of said gate means are received in channels defined by said H-beams.

8. An apparatus as in claim 4, 5, or 6 including means for fixing said gate means in selected vertical positions relative to said float and structural members including a non-flow blocking position.

9. An apparatus as defined in claim 1, in which said structural means is releasably connected to said float.

10. An apparatus as defined in claims 2, 3, 4, 5, or 6 in which structural members of said wall are releaseably connected to said float.

11. A method of quieting flowing water in a work area comprising the steps of lowering a wall supported by a float into the water flow crosswise of the water flow ahead of the work area to divert flowing waters, preventing movement of the float and wall with the water flow by engaging depending structural means connected to the float with an underwater fixed obstruction and maintaining engagement with the obstruction as the float rises and falls with the level of the water and raising at least part of the wall from its position for blocking the water flow when conditions are such that the water flow blocked by the part is to be allowed to proceed, but maintaining engagement of said structural means with said obstruction.

12. A method as defined in claim 11 wherein at least part of the wall is raised to permit water flow blocked by the wall part to proceed directly toward the work area when the water conditions are such that the force of the water flow may cause the float and its depending wall to move with the water flow.

13. A method as defined in claims 11 or 12 wherein substantially the entire wall is moved out of the water under water conditions which may cause the wall and float to move with the water and maintaining engagement of said structural members with the obstruction with the wall raised out of position for blocking the water flow.

14. A method as defined in claims 11, 12, or 13 wherein the water area to be quieted is adjacent the downstream side of a dam and in which the structural members are moved into engagement with the upstream face of the dam.

15. A method as defined in claim 14 wherein the wall is lowered from along one side of the float.

16. A method as defined in claim 12 or 13 wherein the water area to be quieted is adjacent the downstream side of a dam and in which the structural members are moved into engagement with the upstream face of the dam when the water rises and the float is in danger of being carried over the dam to substantially remove the wall or part thereof from the flowing water.

17. A method as defined in claim 16 wherein said wall is lowered from one side of the float.

18. A method as defined in claim 16 wherein structural members for the wall are placed in position along one side of the float to support gates constituting movable parts of the wall and gate members are placed in position between the structural members to be movably supported thereby with the gates being lowered into the water to form the wall between the structural members for blocking and diverting water flow and raised from the water under conditions in which the flow of water is such that the barge may be carried downstream over the dam even though the structural members are maintained in engagement with the dam.

* * * * *